US009718518B2

(12) United States Patent
DaSilva et al.

(10) Patent No.: US 9,718,518 B2
(45) Date of Patent: Aug. 1, 2017

(54) METHODS FOR CONNECTING TO FLOATING STRUCTURES

(71) Applicant: Exmar Offshore Company, Houston, TX (US)

(72) Inventors: Otto DaSilva, Houston, TX (US); M. Ed Nagel, Houston, TX (US)

(73) Assignee: Exmar Offshore Company, Houston, TX (US)

( * ) Notice: Subject to any disclaimer, the term of this patent is extended or adjusted under 35 U.S.C. 154(b) by 0 days.

(21) Appl. No.: 14/932,487

(22) Filed: Nov. 4, 2015

(65) Prior Publication Data

US 2016/0229493 A1 Aug. 11, 2016

Related U.S. Application Data

(60) Provisional application No. 62/112,855, filed on Feb. 6, 2015.

(51) Int. Cl.

| | |
|---|---|
| ***B63B 21/20*** | (2006.01) |
| ***B63B 21/50*** | (2006.01) |
| ***B63B 1/10*** | (2006.01) |
| ***B63B 35/44*** | (2006.01) |
| ***B63B 39/03*** | (2006.01) |
| ***B63B 21/18*** | (2006.01) |
| *B63B 39/06* | (2006.01) |

(52) U.S. Cl.

CPC ..... *B63B 21/20* (2013.01); *B63B 1/107* (2013.01); *B63B 21/18* (2013.01); *B63B 21/50* (2013.01); *B63B 35/44* (2013.01); *B63B 39/03* (2013.01); *B63B 2021/203* (2013.01); *B63B 2039/067* (2013.01)

(58) Field of Classification Search

CPC ..... B63B 21/00; B63B 21/50; B63B 27/00; B63B 27/24; B63B 35/44; B63B 21/502; B63B 2021/505

USPC ..... 114/264, 265, 267; 405/195.1, 223.1, 405/224, 224.2, 200

See application file for complete search history.

(56) References Cited

U.S. PATENT DOCUMENTS 4,007,598 A * 2/1977 Tax ..... E02B 17/021 405/200
4,062,313 A * 12/1977 Stram ..... B63B 21/502 405/223.1

(Continued)

FOREIGN PATENT DOCUMENTS

BR PI0601788 A 1/2008
CN 1780962 A 5/2006

(Continued)

OTHER PUBLICATIONS

Extended European Search Report issued in European Application No. 15195233.0; Dated Jul. 4, 2016, (10 pages).

(Continued)

*Primary Examiner* — Lars A Olson
(74) *Attorney, Agent, or Firm* — Osha Liang LLP

(57) ABSTRACT

A method of connecting a member to a floating structure, the method includes disposing the floating structure in a body of water and attaching the member to the floating structure. The method also includes changing an orientation of the floating structure and aligning the member with a connection device disposed on a lower portion of the floating structure.

19 Claims, 7 Drawing Sheets

(56) References Cited

U.S. PATENT DOCUMENTS

| | | | | |
|---|---|---|---|---|
| 4,808,034 | A | 2/1989 | Birch | |
| 5,269,629 | A | 12/1993 | Langner | |
| 5,707,178 | A * | 1/1998 | Srinivasan | B63B 21/502 405/223.1 |
| 5,791,819 | A * | 8/1998 | Christiansen | B63B 21/50 405/223.1 |
| 6,935,810 | B2 * | 8/2005 | Horton, III | B63B 1/107 114/265 |
| 2002/0070024 | A1 | 6/2002 | Schutz et al. | |
| 2004/0197152 | A1 | 10/2004 | Beard et al. | |

FOREIGN PATENT DOCUMENTS

| | | | |
|---|---|---|---|
| FR | 2441020 | A1 | 6/1980 |
| WO | 2004077951 | A2 | 9/2004 |
| WO | 2004079146 | A2 | 9/2004 |

OTHER PUBLICATIONS

Search Report and Written Opinion issued in Singaporean Application No. 10201509510V; Dated Jun. 2, 2016 (10 pages).
Office Action issued in Korean Application No. 10-2015-0161640; Dated Nov. 25, 2016 (13 pages).
Office Action issued in Chinese Application No. 201510856684 dated May 26, 2017 (11 pages).

* cited by examiner

METHODS FOR CONNECTING TO FLOATING STRUCTURES

BACKGROUND

Field of the Disclosure

Embodiments disclosed herein generally relate to methods for connecting to floating structures. More specifically, embodiments disclosed herein relate to methods for connecting one or more members, such as a riser, to a floating structure, such as a semisubmersible.

Related Art

In oilfield operations, floating structures, such as semisubmersibles ("semis") and barges, are commonly used for various operations, including, but not limited to, hydrocarbon exploration, hydrocarbon drilling and production, safety platforms, and heavy lift cranes. Operations may include a number of risers, tension members, or other equipment capable of connecting to a floating structure.

SUMMARY

In general, in one aspect, the present disclosure relates to a method of connecting a member to a floating structure, the method includes disposing the floating structure in a body of water, attaching the member to the floating structure, changing an orientation of the floating structure, and aligning the member with a connection device disposed on a lower portion of the floating structure.

In general, in another aspect, the present disclosure relates to a method of connecting a member to a semisubmersible, the method includes disposing the semisubmersible in a body of water, attaching the member to an upper hull of the semisubmersible, aligning the member with a connection device disposed on a lower hull of the semisubmersible, and engaging a collar disposed on the member with an adaptor of the connection device.

Other aspects of the disclosure will be apparent from the following description and the appended claims.

DETAILED DESCRIPTION

Figure 1A:
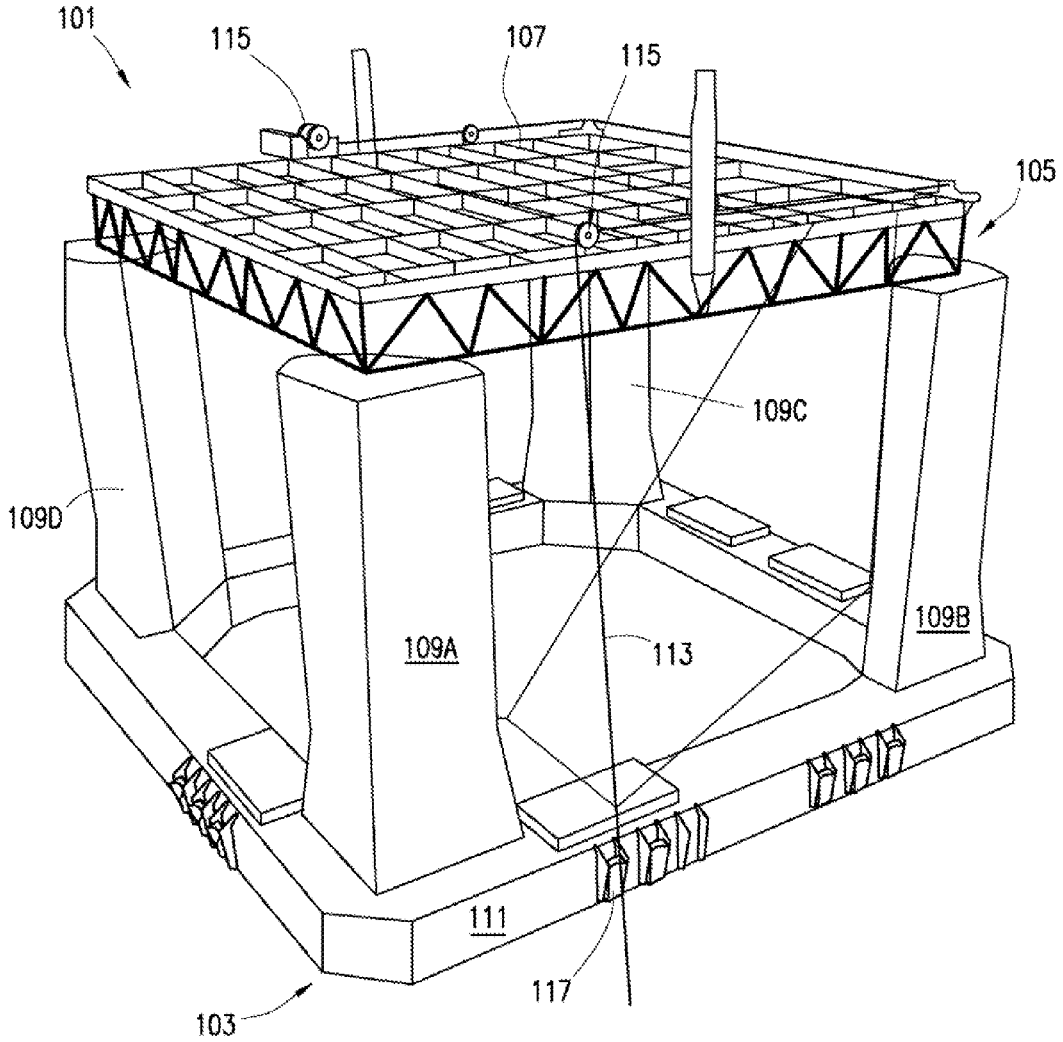
FIGS. 1A-1B show a floating structure in accordance with one or more embodiments of the present disclosure.

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

Furthermore, those having ordinary skill in the art will appreciate that when describing a first element to a second element disposed thereon, it is understood that disposing may be either directly disposing the first element on the second element, or indirectly disposing the first element on the second element. For example, a first element may be directly disposed on a second element, such as by having the first element and the second element in direct contact with each other, or a first element may be indirectly disposed on a second element, such as by having a third element, and/or additional elements, disposed between the first and second elements.

Figure 1B:
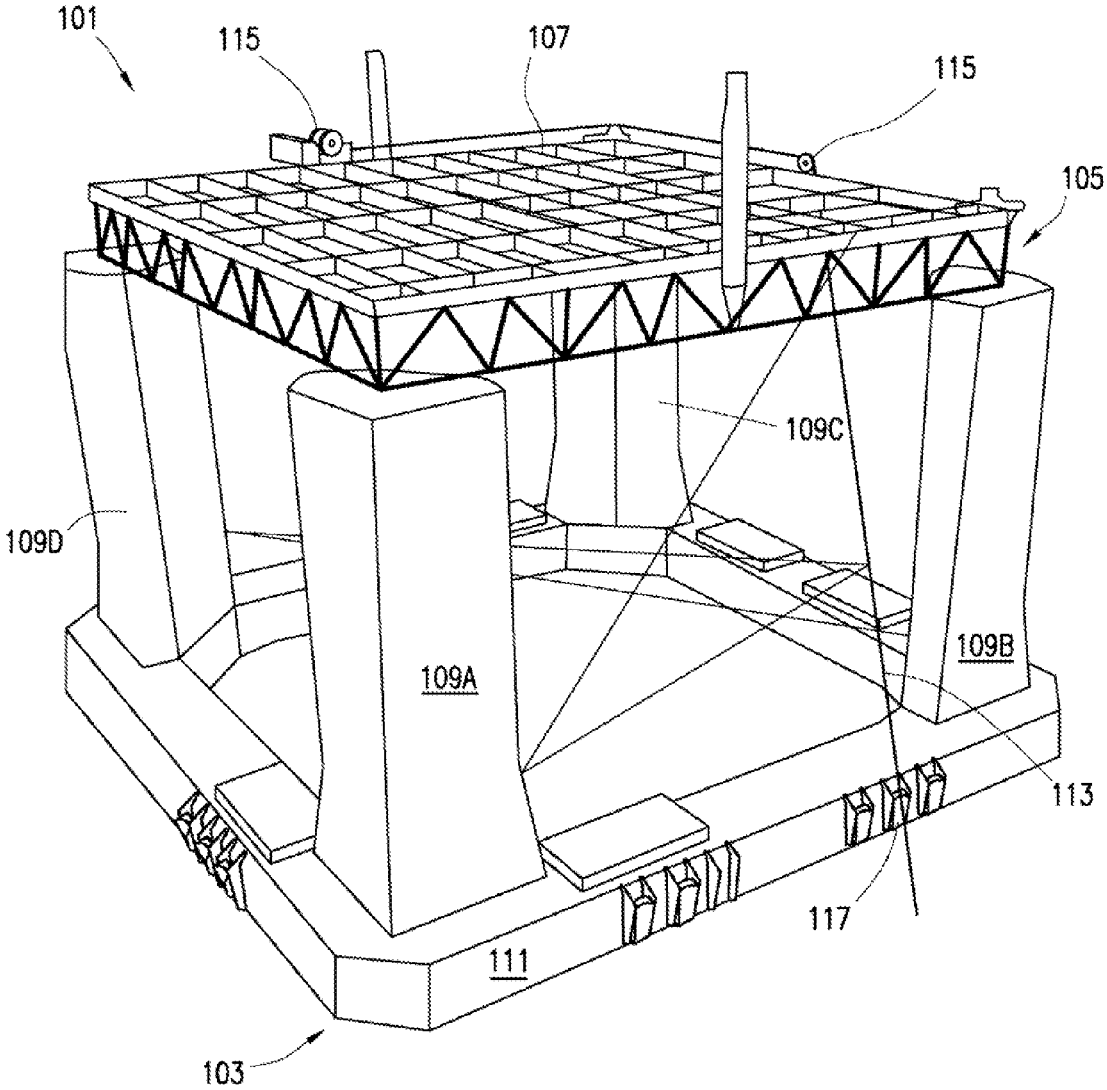

As shown in FIGS. 1A-1B, a floating structure in accordance with one or more embodiments is shown. In one or more embodiments, one or more of the elements shown in FIGS. 1A-1B may be omitted, repeated, and/or substituted. Accordingly, the present disclosure should not be considered limited to the specific arrangements of elements shown in FIGS. 1A-1B.

In FIGS. 1A-1B, a floating structure 101 is shown having a lower portion 103 and an upper portion 105. As shown, the upper portion 105 includes a deck 107 is typically used for drilling, production, or other operations. The deck 107 may be capable of having operating equipment, personnel, and operation gear disposed thereon. The deck 107 may be positioned above the surface of a body of water (not shown) and may be supported by columns 109A, 109B, 109C, and 109D. In one or more embodiments, the floating structure may be disposed offshore (not shown). In some embodiments, the upper portion 105 may be an upper hull of the floating structure 101 and the lower portion 103 may be a lower hull of the floating structure 101.

As shown, the columns 109A, 109B, 109C, and 109D are disposed between upper portion 105 and lower portion 103. The columns 109A, 109B, 109C, and 109D may be used to support the deck 107 and may also serve as storage. In one or more embodiments, the columns 109A, 109B, 109C, and 109D may include one or more ballast chambers. As such, columns 109A, 109B, 109C, and 109D may be used to control buoyancy of the floating structure 101 while offshore. In addition, the floating structure 101 may include a number of the ballastable pontoons and/or chambers (not shown) disposed on or inside one or more of columns 109A, 109B, 109C, and 109D, upper portion 105, and lower portion 103, in order to control the buoyancy and/or center of gravity of the floating structure 101. The ballasted structure(s) (ballasted pontoons, columns, and/or chambers) may be filled with water or any other ballasting material or combination of materials or may release/drain water or any other ballasting material or combination of materials to stabilize and control the buoyancy and adjust the center of gravity of the floating structure 101.

As shown, the lower portion 103 may include a pontoon base 111 having columns 109A, 109B, 109C, and 109D disposed thereon or connected thereto. Similar to the above, the pontoon base 111 may include one or more ballastable chambers (not shown) used to control the buoyancy and adjust the center of gravity of the floating structure 101. The ballasted structure(s) (ballasted pontoons, columns, and/or chambers) may be filled with water or any other ballasting material or combination of materials or may release/drain water or any other ballasting material or combination of materials to stabilize and control the buoyancy of the floating structure 101.

The pontoon base 111 may be substantially rectangular in shape from a side view perspective, a plan view perspective, or both. One having ordinary skill would know that the shape of the pontoon base, deck, and column(s) are not limited to the shapes, sizes, arrangements, and configurations shown in the figures and described above. For example, the floating structure 101 may be a single column floating structure, such as a spar, that includes an upper hull connected to a lower hull using a single column. In addition, or in the alternative, the lower hull of the floating structure 101 may be included on or may be part of one or more columns. As discussed herein, the floating structure 101 may be a semisubmersible, a spar, a caisson vessel, a floating production unit, a barge, or any other floating structure known in the art.

In one or more embodiments, one or more members may be connected to the floating structure 101. The one or more members may be a tension member or mooring line used to maintain or adjust the position of the floating structure 101. In addition, the one or more members may be an umbilical or other line for transferring fluids such as oil and gas or may include electronic wiring for controlling one or more devices. In general, the one or more members may include any member known in the art, such as a tension member, an elongated member, a mooring line, a riser, an anchor line, a wire, a chain, among many others.

For example, a member 113 may be attached to the upper portion 105 of the floating structure 101. In one or more embodiments, the member 113 may be attached to a pulley system 115 disposed on the deck 107 of the upper portion 105. In addition, the member 113 may be connected to the lower portion 103 of the floating structure 101. As shown, the member 113 may be connected to a connection device 117 disposed on or part of the pontoon base 111 of the lower portion 103. In some embodiments, the member 113 may be lowered, using a pulley system 115, for example, into engagement with the connection device 117.

In addition, in one or more embodiments, the ballastable chambers and/or one or more tension members may be used to adjust an orientation or attitude of the floating structure 101. The ballastable chambers and/or one or more tension members may be manipulated to position the floating structure 101 and/or adjust one or more of the six degrees of freedom of the floating structure 101. The six degrees of freedom that may be adjusted using the ballastable chambers and/or one or more tension members may include three axes of movement (forward and backward, upward and downward, leftward and rightward), as well as rotation about each of the aforementioned axes (pitch, yaw, and roll).

In some embodiments, the position, attitude, and orientation of the floating structure 101 may be adjust in order to align a member with a connection device. For example, in one or more embodiments, the position, attitude, and orientation of the floating structure 101 may be adjusted or otherwise manipulated using ballasting techniques and tension members as described herein or known in the art to align member 113 with a connection device 117. Thereafter, the member 113 may be positioned into engagement with the connection device. The member 113 may be positioned by lowering the member into a connection device 117 or an adaptor (not shown) to be attached to the connection device 117.

Figure 2A:
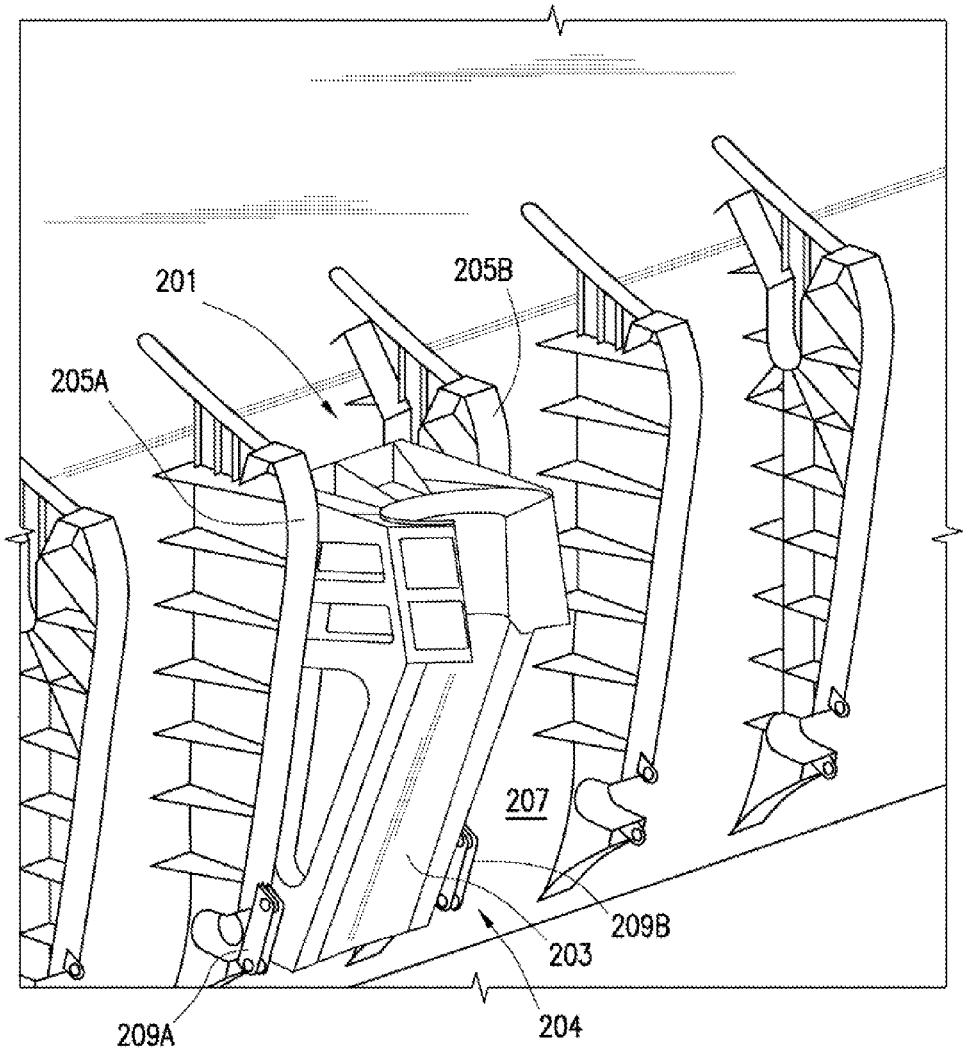
FIGS. 2A-2B show a connection device in accordance with one or more embodiments of the present disclosure.
Figure 2B:
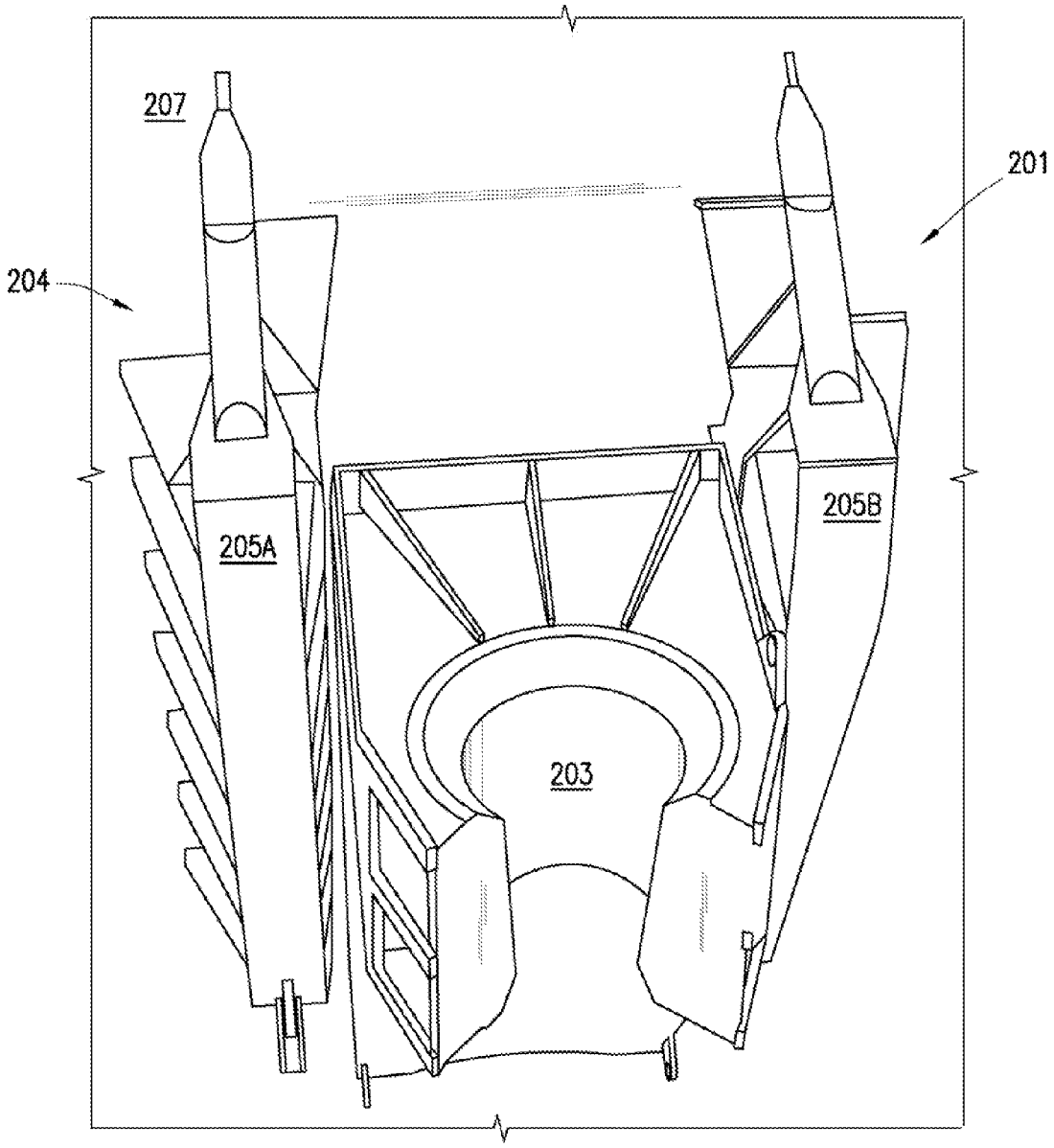

Referring now to FIGS. 2A-2B, a connection device in accordance with one or more embodiments is shown. In one or more embodiments, one or more of the elements shown in FIGS. 2A-2B may be omitted, repeated, and/or substituted. Accordingly, the present disclosure should not be considered limited to the specific arrangements of elements shown in FIGS. 2A-2B.

In FIGS. 2A-2B, the connection device 201 includes an adaptor 203 capable of engaging and disengaging with a porch 204. As shown, the porch 204 may include or be attached to a plate. In this example, the plate includes two side plates 205A and 205B. However, one or ordinary skill would know and appreciate that the plate may include only a single plate or may include a plurality of plates connected to each another and forming a single plate structure capable of housing the adaptor 203.

In one or more embodiments, the side plates 205A and 205B are configured to be affixed to a structure 207. The structure 207 may be a semi-submersible, a column, a pontoon, a lower hull, an upper hull, and/or any other structure or component known in the art. The side plates 205A and 205B may be permanently or temporarily affixed to the structure by welding, bolting, and/or any other means or mechanism known in the art. The side plates 205A and 205B may also be a portion of or built into the structure 207. Further, the side plates 205A and 205B may be affixed to the structure 207 using one or more intermediary affixing devices (not shown), such as a bracket.

In one or more embodiments, the adaptor 203 may be configured to engage and/or disengage from side plates 205A and 205B. Once engaged, the adaptor 203 may be supported and/or secured by latches 209A and 209B. The latches 209A and 209B are configured to limit movement of the adaptor 203 with respect to the side plates 205A and 205B. In other embodiments, the adaptor 203 may be an integral part of side plates 205A and 205B to form a single unit. In addition, or in the alternative, the adaptor 203 and side plates may be part of the structure 207 or may be a single unit formed within the structure 207. The adaptor 203 may be configured to attach to equipment or other structures, such as members including, but not limited to, wires, mooring lines, risers, chains, etc.

Figure 3A:
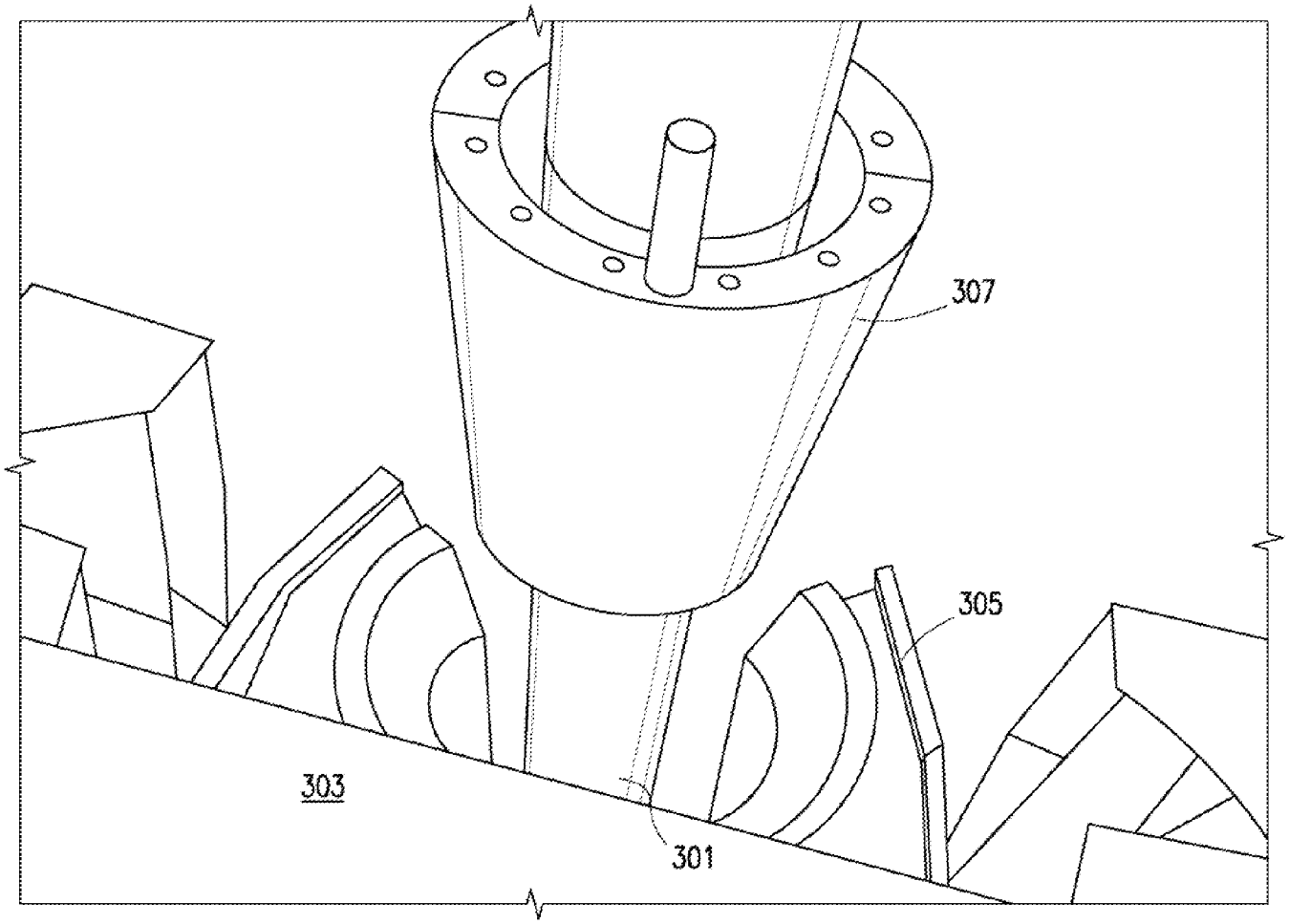
FIGS. 3A-3B show a member and connection device in accordance with one or more embodiments of the present disclosure.
Figure 3B:
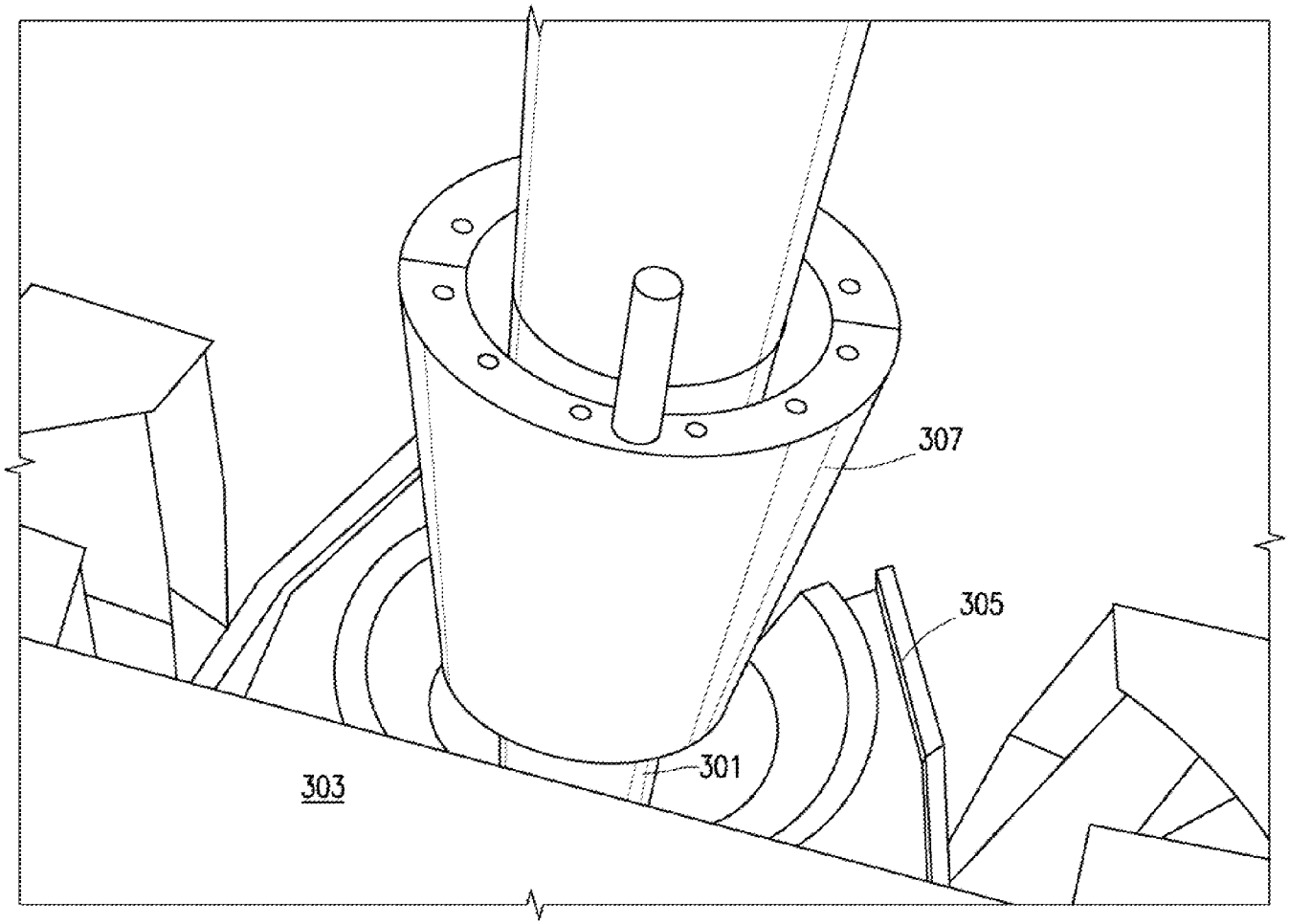

Referring now to FIGS. 3A-3B, a connection device and member in accordance with one or more embodiments is shown. In one or more embodiments, one or more of the elements shown in FIGS. 3A-3B may be omitted, repeated, and/or substituted. Accordingly, the present disclosure should not be considered limited to the specific arrangements of elements shown in FIGS. 3A-3B.

As shown in FIGS. 3A-3B, a member 301 may be connected to lower hull 303 of a floating structure, as discussed above. In one or more embodiments the lower hull 303 of the floating structure may be disposed in a body of water and in particular, the lower hull 303 may be below the surface of the water. The member 301 may be attached at a distal end to an upper hull of the floating structure (not shown). In other embodiments, the member 301 may be attached to the upper hull of the floating structure at any point along the length of the member 301. The member 301 may also be engaged with or attached to a pulley system, as discussed above. The pulley system may be used to control the position of the member 301 or may serve as an attachment point on the upper hull to which the member 301 may attach.

As shown, the member 301 may be connected to a lower hull 303 by adjusting the position of the member 301 with respect to the floating structure and the lower hull 303. The position of the member 301 may be adjusted using a pulley system, as described above, or by using a winch system connected to or separate from the floating structure that is used to push and/or pull the member 301 into a specific position with respect to the floating structure. In addition, or in the alternative, the position and/or orientation of the floating structure may be adjusted with respect to the member 301.

As shown in FIGS. 3A-3B, in one or more embodiments, the orientation of the floating structure may be adjusted or changed to align the member 301 with respect to the lower hull 303. Further, the orientation of the floating structure may be adjusted to align the member 301 with respect to a connection device 305 disposed on or part of the lower hull 303.

To change or adjust the orientation of the floating structure with respect to the member 301, one or more ballast chambers may be manipulated. As mentioned above, the one or more ballast chambers may be included within or disposed on any component of the floating structure such as, but not limited to, the lower hull, the upper hull, one or more columns, or any other structure known in the art. The buoyancy of the floating structure may also be adjusted to control or change the orientation of the floating structure with respect to the member. The buoyancy of the floating structure may be adjusted by any means known in the art, such as, by changing the water place effective area or the spring stiffness of the floating structure or by filling and/or draining one or more ballast chambers of the floating structure, for example.

Figure 4:
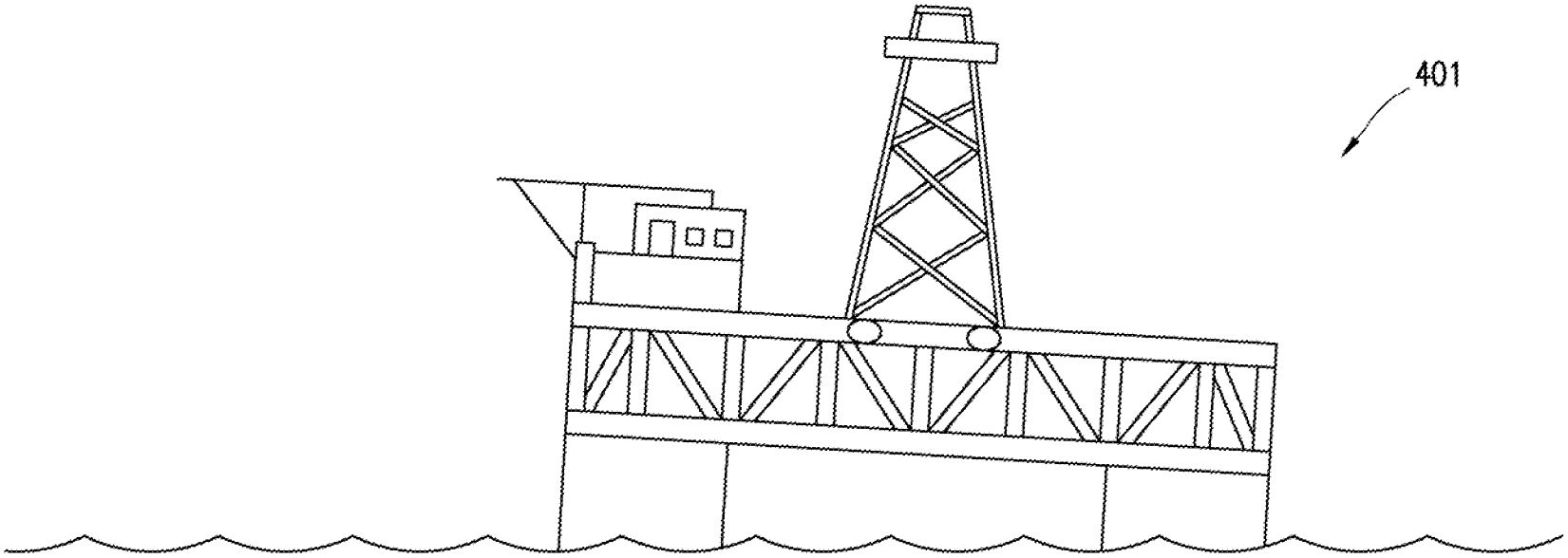
FIG. 4 shows a floating structure in accordance with one or more embodiments of the present disclosure.

Referring to FIG. 4, a floating structure 401 is shown with an orientation that was adjusted by controlling and/or manipulating the buoyancy of the floating structure 401 in accordance with one or more embodiments herein. As shown, the floating structure 401 is not level with respect to the horizon. In particular, the attitude and/or orientation of the floating structure 401 is skewed with respect to normal and/or a normal axis Referring back to FIGS. 3A-3B, once the member 301 is aligned with the lower hull 303 and/or the connection device 305, the member 301 may be guided into a proper position with respect to the lower hull 303. As shown in FIGS. 3A-3B, the member 301 includes a collar 307 configured to correspond with the connection device 305. In particular, the collar 307 is designed having a tapered portion that is capable of being guided into engagement with the connection device 305. Similarly, the connection device 305 may include an adaptor having a tapered portion that guides the tapered portion of the collar 307 into position. In one or more embodiments, the member 301 may slide with respect to the connection device 305 and may be properly fitted and connected to the lower hull 303 of the floating structure. For example, by lowering the member 301 relative to the connection device 305, the member 301 may engage with the connection device 305 and may be connected to the floating structure.

In one or more embodiments, the member 301 may include an adaptor configured to engage with a porch of the connection device. For example, an adaptor that corresponds to a porch and/or side plates of a connection device may be disposed on or attached to the member 301. Once attached, the member 301 may then slide into place, as described above, such that the member 301 engages the connection device 305 of the lower hull 303 and is connected to the floating structure.

Further, in one or more embodiments, the position of the member 301 with respect to the floating structure may also be adjusted a winch system and/or a pulley system, as described above. In addition, or in the alternative, the position of the member 301 with respect to the floating structure by attaching a portion of or a distal end of the member 301 to an underwater apparatus, such as a submarine and controlling the position of the member 301 using the underwater apparatus (not shown).

As discussed above, the member 301 may include any one of a tension member, an elongated member, a mooring line, a riser, an anchor line, a wire, a chain, or any other member known in the art. The ballasted structure(s) (ballasted pontoons, columns, and/or chambers) may be filled with water or any other ballasting material or combination of materials or may release/drain water or any other ballasting material or combination of materials to stabilize and control the buoyancy of the floating structure. Further, the attitude and one or more of the six degrees of freedom of the floating structure may be adjusted and/or manipulated in order to align a member with the floating structure. As mentioned above, the floating structure may be any floating structure such as a semisubmersible, a platform, a caisson vessel, a floating production unit, a barge, or any other offshore structure known in the art.

The methods of connecting a member to a floating structure in accordance with one or more embodiments may efficiently and quickly connect one or more members to a floating structure. Such methods may also not require the use of a winch system used to pull and/or push the member into a specific position with respect to a floating structure. In addition, personnel and equipment for operating such systems may be reduced, thus reducing the number of at risk personnel and amount of resources that may be otherwise necessary to perform such connections.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method of connecting a tension member to a floating structure, the method comprising:

disposing the floating structure to have a first orientation in a body of water;

attaching the tension member to an upper portion of the floating structure; and positioning the floating structure to have a second orientation that is not level with the horizon, wherein the positioning comprises moving the floating structure in relation to the tension member such that the tension member aligns with a connection device affixed to a lower portion of the floating structure.

2. The method of claim 1, wherein attaching the tension member to the floating structure comprises suspending the tension member from the upper portion of the floating structure.

3. The method of claim 1, wherein attaching the tension member to the floating structure comprises suspending the tension member from an attachment device disposed on an upper hull of the floating structure.

4. The method of claim 1, further comprising engaging the tension member with the connection device by lowering the tension member into the connection device.

5. The method of claim 4, wherein engaging the tension member with the connection device comprises engaging a collar disposed on the tension member with an adaptor of the connection device.

6. The method of claim 4, wherein engaging the tension member with the connection device comprises engaging the tension member with an adaptor and attaching the adaptor to the connection device.

7. The method of claim 4, wherein engaging the tension member with the connection device comprises sliding an adaptor of the connection device along a tapered portion of a collar disposed on the tension member.

8. The method of claim 6, wherein the tapered portion of the collar corresponds with a tapered portion of the adaptor.

9. The method of claim 1, wherein positioning the floating structure to have a second orientation comprises manipulating one or more ballast chambers of the floating structure to adjust an attitude of the floating structure.

10. The method of claim 9, wherein to adjust the attitude of the floating structure comprises manipulating one or more mooring lines to adjust at least one of six degrees of freedom of the floating structure.

11. The method of claim 9, wherein manipulating one or more ballast chambers comprises at least one of filling and draining a portion of one or more ballast chambers to adjust buoyancy and a center of gravity of the floating structure.

12. The method of claim 1, wherein the floating structure comprises at least one selected from the group consisting of a floating production unit, a semisubmersible, a barge, a spar platform, and an offshore vessel.

13. A method of connecting a member to a semisubmersible, the method comprising:

disposing the semisubmersible having a first orientation in a body of water;

attaching the member to an upper hull of the semisubmersible;

positioning the semisubmersible to have a second orientation that is not level with the horizon, the positioning comprising aligning the member with a connection device disposed on a lower hull of the semisubmersible; and engaging a collar disposed on the member with an adaptor of the connection device.

14. The method of claim 13, wherein aligning the member with the connection device comprises manipulating a portion of a ballast chamber to adjust an attitude of the semisubmersible.

15. The method of claim 13, wherein aligning the member with the connection device comprises at least one of filling and draining one or more ballast chambers to adjust a buoyancy and a center of gravity of the semisubmersible.

16. The method of claim 13, wherein aligning the member with the connection device comprises moving weight about the semisubmersible to adjust buoyancy and a center of gravity of the semisubmersible.

17. The method of claim 13, wherein aligning the member with the connection device comprises adjusting the member with respect to the semisubmersible.

18. The method of claim 13, wherein engaging the collar of the member with the adaptor of the connection device comprises moving the member relative to the connection device.

19. The method of claim 13, wherein the member comprises at least one selected from the group consisting of a tension member, a riser, a mooring line, and an umbilical.

* * * * *